US006260462B1

(12) United States Patent
Daysh

(10) Patent No.: US 6,260,462 B1
(45) **Date of Patent: *Jul. 17, 2001**

(54) METHOD AND DEVICE FOR OPENING CARTONS

(76) Inventor: William George Edward Daysh, Hillmorton, Hillbrow Road, Esher, Surrey KT10 9UD (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/023,045

(22) Filed: Feb. 13, 1998

Related U.S. Application Data

(63) Continuation of application No. 08/586,904, filed on Jan. 26, 1996, now abandoned.

(30) Foreign Application Priority Data

Jul. 28, 1993 (GB) ..... 9315556

(51) Int. Cl.[7] ..... B27B 5/00

(52) U.S. Cl. ..... 83/743; 83/745; 83/912; 30/289; 30/294; 30/258; 30/254

(58) Field of Search ..... 30/289, 2, DIG. 3, 30/294, 258, 254; 83/743, 745, 912

(56) References Cited

U.S. PATENT DOCUMENTS

| | | | | |
|---|---|---|---|---|
| 84,902 | * | 12/1868 | Porter | 30/258 |
| 1,975,191 | * | 10/1934 | Calef | 83/743 |
| 2,233,497 | * | 3/1941 | Teigen | 30/289 |
| 2,333,284 | * | 11/1943 | Willers | 30/258 |
| 2,535,555 | * | 12/1950 | Tilly | 30/289 |
| 2,573,381 | * | 10/1951 | Arnold | 30/289 |
| 2,624,936 | * | 1/1953 | Jensen | 30/289 |
| 2,773,523 | * | 12/1956 | Hopla | 83/745 |
| 3,035,581 | * | 5/1962 | Bonta | 30/289 |
| 3,178,812 | * | 4/1965 | Lurie | 30/289 |
| 3,184,843 | * | 5/1965 | Lurie | 30/289 |
| 3,641,667 | * | 2/1972 | Leopoldi | 30/2 |
| 3,781,988 | * | 1/1974 | Jones | 30/2 |
| 3,803,713 | | 4/1974 | Jones et al. . | |
| 3,889,367 | * | 6/1975 | Walker | 30/289 |
| 4,291,461 | * | 9/1981 | Hansen | 30/289 |
| 4,434,555 | * | 3/1984 | Stoll | 30/258 |
| 4,467,524 | * | 8/1984 | Ruff et al. | 30/289 |
| 4,527,455 | * | 7/1985 | Morax | 83/912 |
| 4,711,031 | * | 12/1987 | Annello | 30/DIG. 3 |
| 5,048,188 | * | 9/1991 | Wolff | 30/289 |
| 5,285,575 | * | 2/1994 | Hirano | 30/2 |
| 5,285,577 | * | 2/1994 | Carney et al. | 30/289 |
| 5,740,610 | * | 4/1998 | Ayer et al. | 30/2 |

* cited by examiner

*Primary Examiner*—M. Rachuba
(74) *Attorney, Agent, or Firm*—James Creighton Wray; Meera P. Narasimhan

(57) ABSTRACT

Cartons of the type used for domestic milk supply may be more readily opened if a portion of the ridge that extends above the wings of the carton is first severed between the wings and the heat sealed closure so that the severed portion of the ridge may be folded back from above the wings or removed by a further cut across the ridge to the first line of sever. The wings are then free to be folded back and pressed inward to open the carton to form a pouring lip. A device for opening cartons comprises a thin blade secured to a handle and hinged within a shrouded recess in a two-part housing. Handles act about the double action hinge to move the blade across the slot to sever a portion of the carton ridge positioned in the slot. A tongue (not shown) holds the device in alignment with the ridge to ensure that the severing is below the sealed portion of the ridge.

9 Claims, 6 Drawing Sheets

FIG. 19
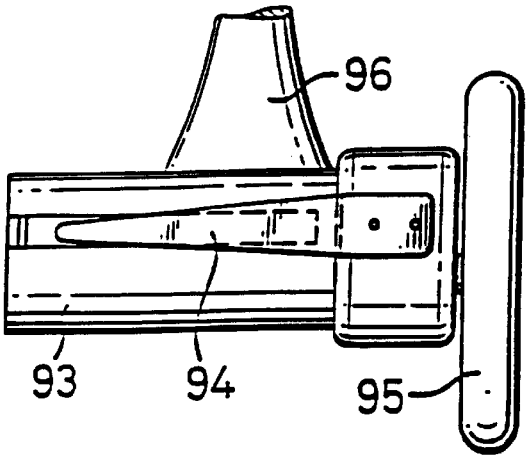
FIG. 20
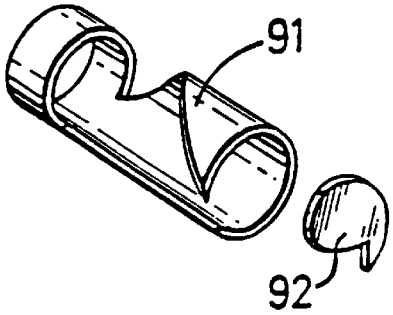
FIG. 21
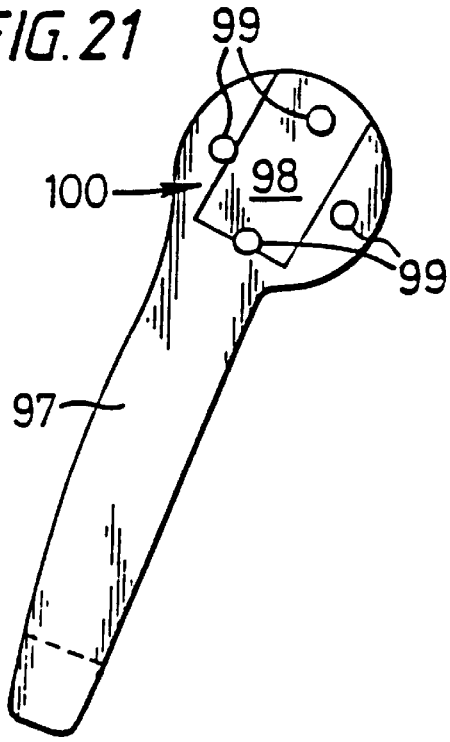
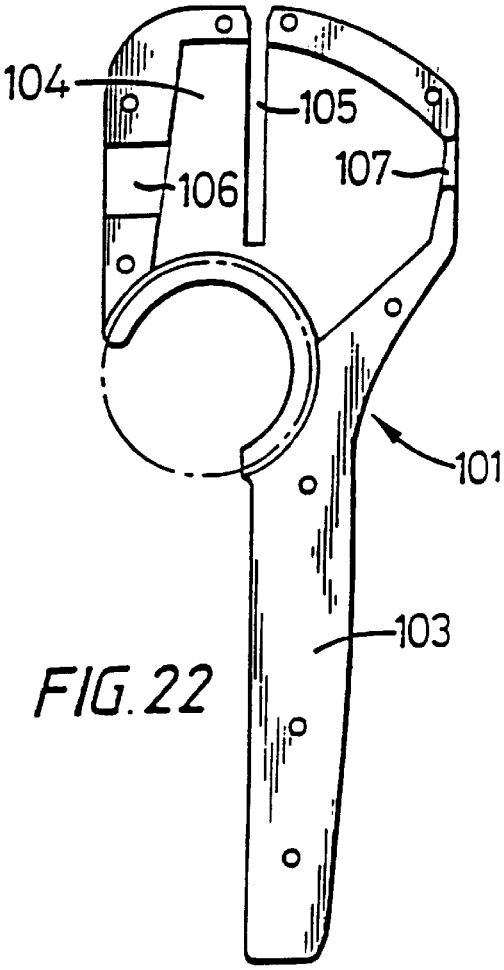
FIG. 22

METHOD AND DEVICE FOR OPENING CARTONS

This application is a continuation of application Ser. No. 08/586,904, filed Jan. 26, 1966, abandoned.

THE INVENTION

The invention relates to a method of opening waxed paper or plastics or metal foil coated paper board cartons and the like containing liquid, semi-liquids or powders that may be poured, and to a device for opening such cartons. In particular, the invention provides a hand-held or wall-mounted means for enabling the seal closures of milk cartons and the like to be severed so that the carton may be readily opened and re-closed, but not re-sealed, as required.

BACKGROUND TO THE INVENTION

The type of paper carton used particularly for domestic milk supply is well known. The form of carton is marketed under the Registered Trade Marks "ELOPAK", or "TETRA PAK". Such cartons are sealed by inclining the upper portions of the side walls inward with two opposite faces folded together to form so called "wings", and heat treating or otherwise sealing the mating internal extremities of the inclined portions to form a ridge. This ridge may be folded flat on the upper face of the carton, or it may be left in an upstanding attitude so that the upper face of the carton appears "gabled". The flat top types of cartons generally have tongues at each end of the folded ridge which are detachably secured to the side walls of the carton to keep the ridge in a flat folded position for transportation and sales display. Printed on such cartons are opening instructions, sometimes with illustrations.

However, many people find the opening instructions difficult to follow. People who are not particularly dextrous find their failure to open the cartons very frustrating. The failed attempts to open the cartons as instructed, can cause the wings to be tom, badly buckled or otherwise mutilated. This is hygienically undesirable and may cause the milk or other liquid in the carton to pour badly or dribble down the outside of the carton.

PRIOR ART

It is known to cut the entire ridge closure from the upper face of the carton. This action enables the entire upper face of the carton to be opened but not readily closed. It is also known to cut off part or all of one of the wings to gain access to the contents of the carton. Neither solution is a satisfactory alternative to the suggested instructions on the cartons.

NOVEL ASPECTS OF THE INVENTION

The present invention recognizes that the suggested method of opening cartons would be satisfactory if the force required to release the carton closure by applying a force to the wings could be significantly reduced. The present invention facilitates the opening of cartons simply and cleanly. It severs and removes a segment of the closure ridge of the carton so that the wings are no longer secured together and are free to be opened in accordance with the general instructions.

STATEMENTS OF INVENTION

According to a first aspect of the present invention there is provided a method of opening cartons having a body within which a pourable material is stored, and a winged sealed ridge closure, comprising the steps of: (a) severing substantially half of the sealed portion of the ridge closure from the body of carton along a first line substantially parallel to the ridge; (b) removing the severed portion of the ridge from above the wings; (c) folding the wings back through at least 90° and, (d) pressing the opposed wings towards the ridge to open the carton.

The severed portion of the ridge may be removed from above the ridge by bending or a second severing action. The line of bending or second severing may be inclined to the first line between 45° and 150°.

The second severing action may be effected at the same time as the severing of the ridge from the body of the carton.

According to a second aspect of the invention there is provided a device to facilitate the opening cartons according to the first aspect of the invention, which device includes a guide slot for locating the ridge, a first severing means for severing a portion of the ridge closure along a first line and limiting means for limiting the length along the first line that is severed.

The device may include a second severing means for severing the ridge along a second line meeting the first line substantially in the middle of the length of the ridge and at an angle between 45° and 150°.

Preferably the severing means is a thin cutting blade, although it may be shearing means, guillotine means, or, snipping means. The severing action may be achieved by the force applied between a first and a second handle, or by a motor, or by reaction between the device and the carton in line with the ridge. The device is preferably constructed to achieve a mechanical advantage sufficient to enable a relatively weak force to be applied to the device to effect the required severing action.

The device may include a tongue aligned with the guide slot for supporting the device in the required alignment during the severing action. The tongue fits under the ridge between the wings to ensure that the blade severs the carton along the first line below the sealed portion of the ridge.

The first and second means for severing may be formed together so as to sever the ridge along the first and second lines simultaneously. The severing means may be detachable for replacement, sharpening or cleaning.

The device may include a second guide means for bearing on the edge of the ridge remote from the first line of severing to maintain the first line substantially parallel to the edge of the ridge. This ensures that the sealed portion of the ridge is removed to leave the wings free to be opened.

DESCRIPTION OF THE DRAWINGS

The invention will now be described, by way of example, with reference to the accompanying diagrammatic drawings in which:

FIGS. 19 and 20 illustrate aspects of a wall-mountable device with a rotary severing action; and, FIGS. 21 to 24 show the component part for assembling a preferred embodiment of the device.

SPECIFIC DESCRIPTION

Figure 1:
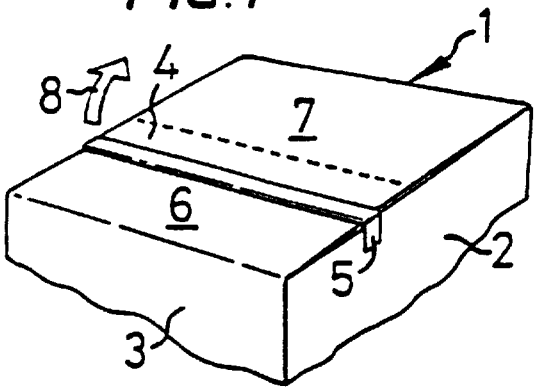
FIGS. 1 to 6 illustrate the stages of opening a carton according to the invention.

The method of performing the invention will now be described with reference to FIGS. 1 to 7 of the drawing. FIGS. 1 to 7 illustrate the upper portion of a milk carton 1 having a body formed by a substantially square base, four side walls, and a sealed folded flat-top. Opposite side walls 2 are folded inward to permit the opposite side walls 3 to be inclined together to meet in a ridge 4 which is folded flat and held in place by tongues 5 which are secured to the side walls 2. In such cartons the shorter side walls 2 are folded inward, although in the embodiment shown the carton is of substantially square cross section. The inclined portions 6 and 7 of the side walls 3 may be longer than the width of the side walls 2 so that the top of the carton form a gabled top.

Figure 2:
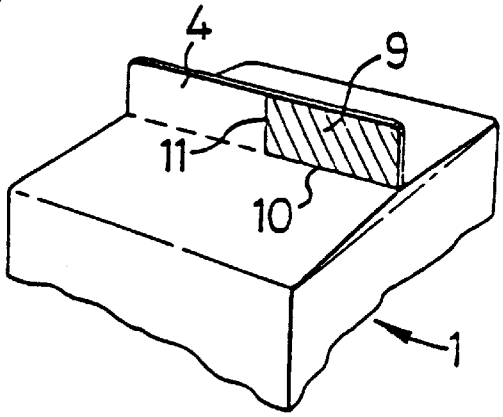
Figure 3:
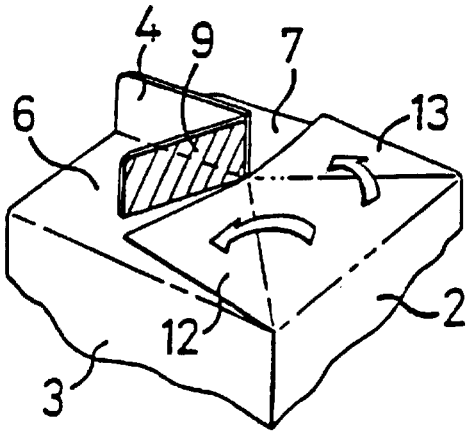
Figure 4:
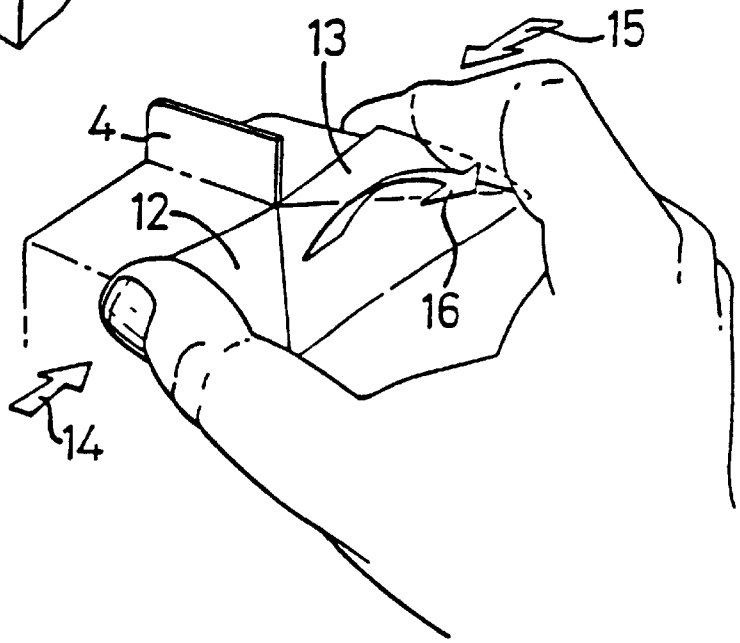
Figure 5:
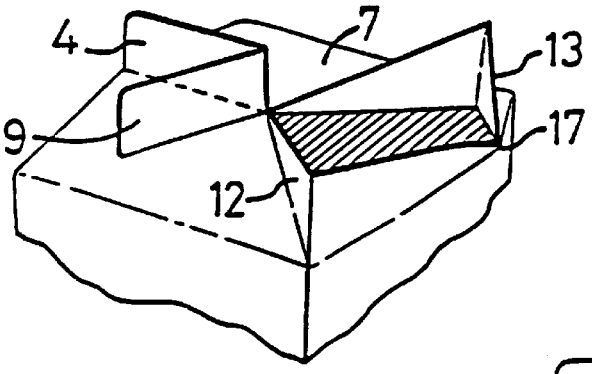
Figure 6:
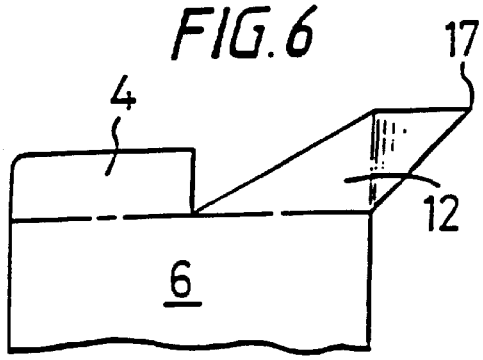

To open the carton the tongues 5 are detached from the side walls 2 and the ridge 4 is lifted in the direction shown be the arrow 8 in FIG. 1. The next step in opening the carton is shown in FIG. 2. The shaded portion 9 of the ridge 4 is removed from above the wings by severing the heat sealed closure segment along line 10 and folding or severing along the line 11. Then, as shown in FIG. 3, wings 12 and 13 are folded back by at least 90° onto the inclined portions 6 and 7, as generally instructed by the opening instructions and illustrations printed on the carton. The final step is to press inward in the direction of arrows 14 and 15 towards the ridge (as shown in FIG. 4). This pressure springs the wings 12 and 13 open in the direction of the arrow 16. The top of the carton 1 is then in an open position as shown in FIGS. 5 and 6 illustrating the form of pouring lip 17 formed by the opened wings 12 and 13. The carton may be reclosed, but not resealed, by pushing the pouring tip in the direction of the ridge.

Figure 7:
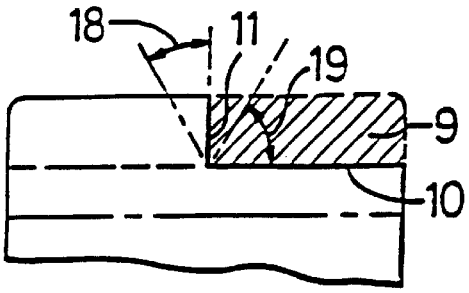
FIG. 7 shows the optional range within which the carton closure ridge may be folded or severed.

Referring now to FIG. 7, the lines 10 and 11 along which the ridge 4 is severed or folded is shown in FIGS. 1 to 6 as orthogonal. However the angle between the lines 10 and 11 is not critical and may be varied by increasing the angle by an additional angle 18. The angle the lines 10 and 11 may lie between 45° and 150°, although it is preferably limited to 60° so that the remaining part of the ridge 4 does not interfere with the opening of the wings 12 and 13. By selecting the angle 19 between the lines 10 and 11 the remaining part of the ridge can assist the re-closing of the carton by holding the wings 12 and 13 in a closed position.

Figure 8:
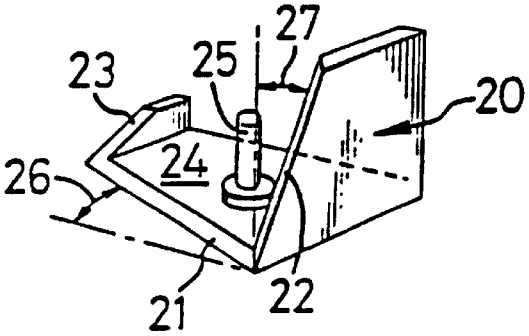
FIGS. 8 and 9 illustrate blades for severing the ridge closure of the carton.
Figure 9:
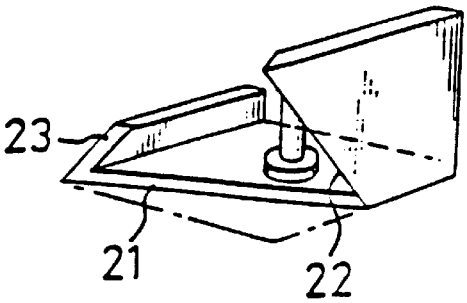

FIGS. 8 and 9 show a form of cutter blade 20 comprising a section 21 for severing along the line 10 which is substantially parallel to the ridge 4, a section 22 for severing across the height of the ridge 4 along the line 11 which is orthogonal to the line 10, a section 23 which bears on the edge of the ridge to act as a guide to limit the length of the severed portion of the ridge 4, and, a back plate 24 having a post 25 which is used to correctly locate and help to secure the cutter blade in a carton opening device. The cutting angle along the line 10 is shown by the angle. 26, and the cutting angle along the line 11 is shown on FIG. 8 by the angle 27. These angles are set to assist the cutting action and to reduce the force required to sever the portion 9 of the carton.

FIG. 9 shows an alternative form of cutter blade in which the integers which perform the same function as those described with reference to FIG. 8 are given the same reference numerals. It will be seen that the angles 26 and 27 in FIG. 8 are reversed in the alternative form of blade. This reversal of the angles helps to maintain the ridge within the carton opening device whilst the severing is effected.

Figure 10:
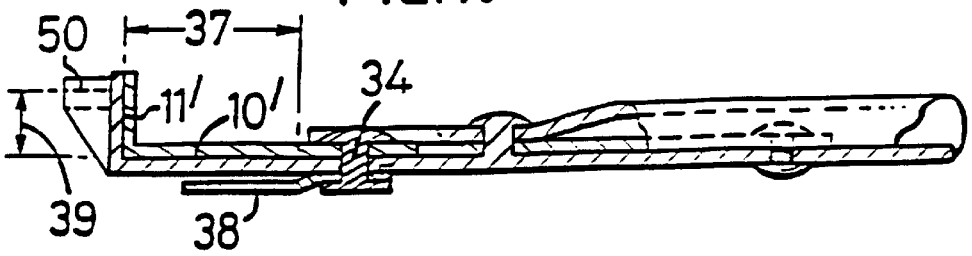
FIGS. 10 and 11 show a hand-held device for opening cartons using a shearing action.
Figure 11:
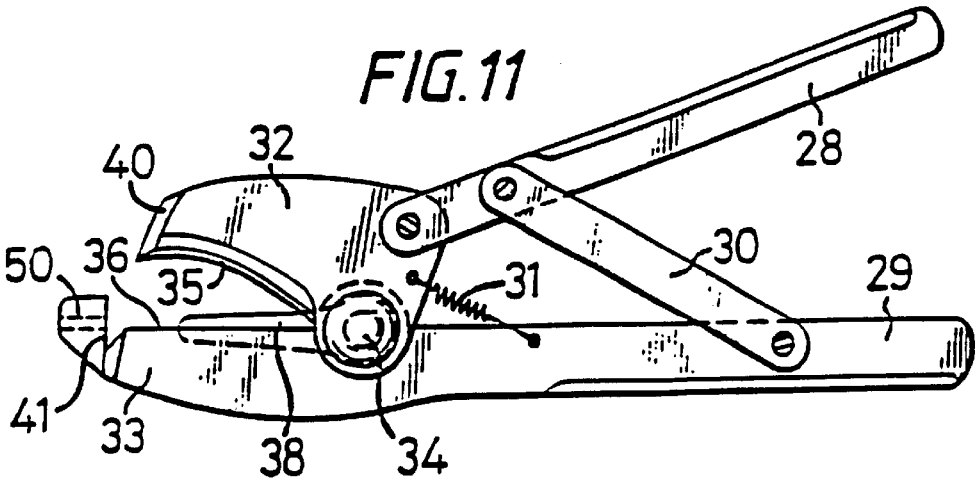

Referring now to FIGS. 10 and 11 which show a hand-held device basically comprising handles 28 and 29 joined by a link arm 30 which act against a spring 31 to close jaws 32 and 33 which pivot about a post 34. The jaw 32 has an arcuate blade cutting edge 35 which cooperates with a corresponding edge 36 on the jaw 33, The edges 35 and 36 determine the lateral line of sever of the carton along the line 10' shown on FIG. 10. The maximum length of cut 37, as shown on FIG. 10, is determined by the length of the cutting edge 35, however this is set by the positioning of a guide 38 which fits below the wings of the carton. The vertical line of sever of the carton along the line 11' shown on FIG. 10 is determined by the edges 40 and 41. The maximum length of the cut 39 is determined by the length of upstanding edges 40 and 41 on jaws 32 and 33 respectively. The preferred depth of the cut 39 may be set as described later with reference to FIG. 12.

In an alternative device (not shown) the severing blade or blades may be replaced by a cut and pinch jaw assembly. The severing action provided by such a device is suited to a static surface-mounted or wall-mounted device.

Figure 12:
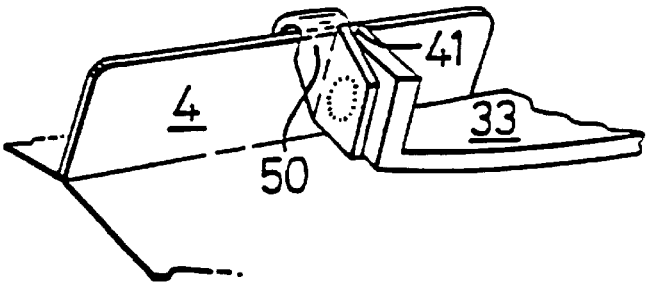
FIG. 12 illustrates the operation of a guide member to control the depth of severing.

If the ridge 4 (shown in FIGS. 1 to 6) is to be severed across its entire height, instead of being folded back, the depth of severing must extend from the top edge of the ridge 4 to the root of the ridge so as to remove the sealed closed portion of the ridge. This depth may be controlled by a guide 50 which rests on the top edge of the ridge 4 as shown in FIG. 12. The positioning of the carton opening device is assisted by the tongue guide 38, which holds the severing blade parallel to the ridge so that the carton is severed below the level at which the carton ridge is sealed.

Figure 13:
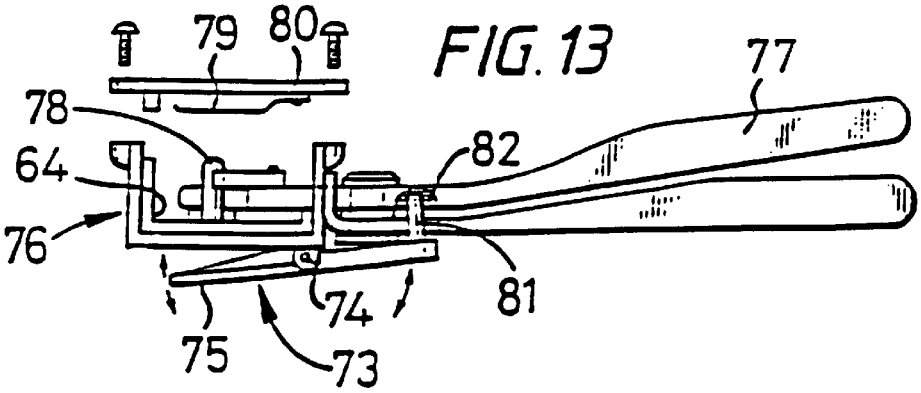
FIG. 13 illustrates an alternative form of guillotine cutter device with a retractable tongue guide.
Figure 14:
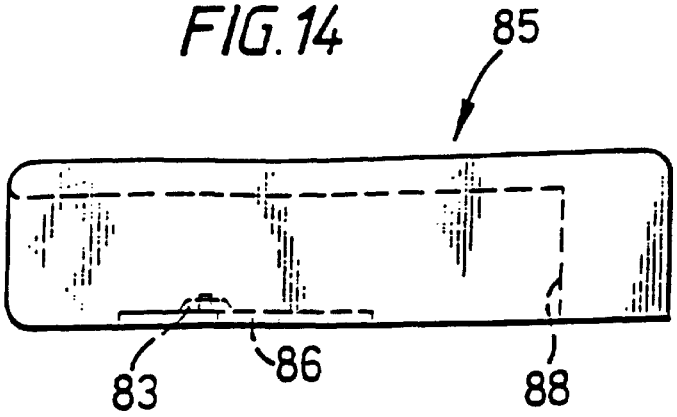
FIGS. 14 to 18 illustrate two forms of hand-held devices for running along the ridge of a carton to effect the severing.
Figure 15:
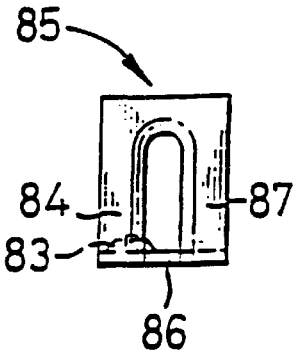
Figure 16:
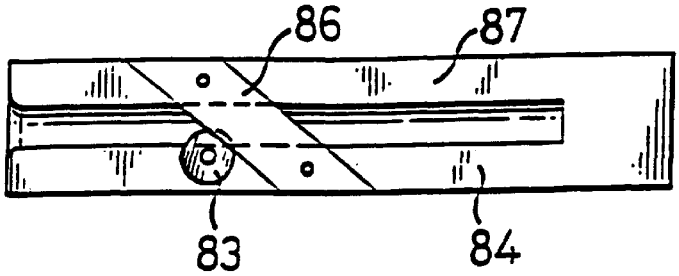

FIG. 13 shows a further form of device for severing a portion of the ridge of a carton. In particular the device includes a retractable guide 73 pivoted about a pin 74 so that a leg 75 of the guide fits under the wings of the carton and is retracted to clamp a guillotine assembly 76 in position after it has been located on the top of the ridge 4. This ensures that the lateral line 10 is accurately aligned to sever the carton along the ridge line of the carton. The device has a handle 77 which is moved against the return action of a spring (not shown) to cause the cutter blade 64 located on post 78 on the handle 77 to co operate with the fixed cutter guillotine blade to sever the ridge 4. The ridge 4 is positioned by a spring steel pressure plate 79 mounted on a back plate 80 and the guide 73. The guide 73 has a keeper pin 81 which is depressed by the initial movement of the handle 77 causing contact with a chamfered ramp 82 on the handle. The guide 73 is sprung to return to the open position. The pressure plate 79 bears against a post 78 on the cutter blade 64 to maintain contact pressure on the cutting edge.

It will be appreciated that the severing of the ridge of the carton may be effected by shearing members, snipping members, guillotine members or, cutting members. The device may be hand-held or mounted on a fixed surface such a wall or work surface.

A simple form of device is shown in FIGS. 14 to 18. In a first form of the device illustrated in FIGS. 14 to 16 the severing is achieved by a fine cutting wheel 83 mounted at the foot of a side limb 84 of a U-shaped channel 85. A cross guide 86 is secured between side limb 87 and the side limb 84. An end stop 88 terminates the channel 85.

In use the channel 85 is pushed along the ridge of a carton. The guide 86 holds the ridge against the wheel 83 which severs the ridge along the line 10 (shown in FIG. 2). The length of cut performed by the wheel 83 is limited to the line 11 (shown in FIG. 2) by the end of the carton ridge bearing against the end stop 88. The device is then withdrawn from the carton and the severed portion of the ridge folded back to free the wings for opening in the normal way.

Figure 17:
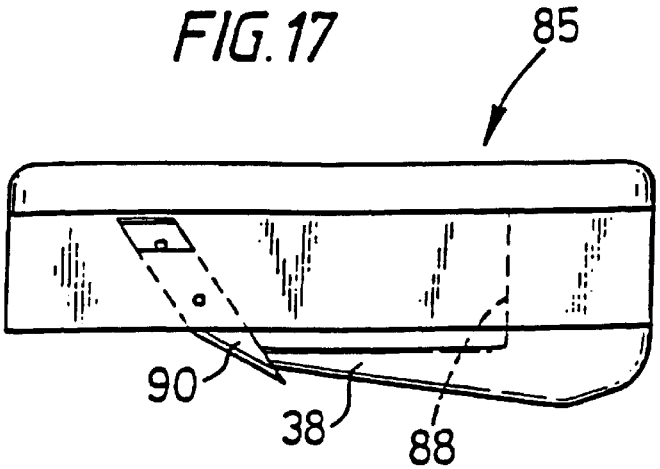
Figure 18:
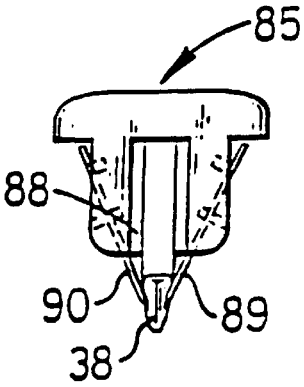

As shown in FIGS. 17 and 18 the cutting wheel 83 and the guide 86 may be replaced by a single or opposed pair of blades 89 and 90 acting in co-operation with a tongue guide 38 which locates between the wings below the ridge as described with reference to FIG. 10.

The severing action may be linear or rotary. As shown in FIGS. 19 and 20 a work surface or wall-mounted rotary device includes a first severing blade 91 for effecting the cut along the line 10 (shown in FIG. 2) and a second severing blade 92 for effecting the cut along the line 11 (shown in FIG. 20). The severing blades 91 and 92 are mounted in a housing, 93 having a tongue 94 to locate under the gabled ridge and to limit the length of the ridge that is severed. It will be appreciated that as the cartons are substantially square the wings project half way into the ridge from both sides. Therefore the limitation for severing is substantially half way along the ridge. The blades are rotated within the housing 93 by a wheel 95 or an electric motor. The device is mounted on a wall or supported on a work surface by a bracket 96.

FIGS. 21 to 24 show a preferred embodiment of the invention. The carton opening device shown in its component parts in FIGS. 21 to 24 includes means for lifting the ridge of flat top cartons, a shrouded blade for safety, hinge means for providing a mechanical advantage to assist the severing action, and, cleaning ports to prevent a build-up of waste material within the shrouded cavity of the device. The device is suitable for opening gabled cartons and brick type cartons such as those marketed as "COMBIBLOC".

Figure 23:
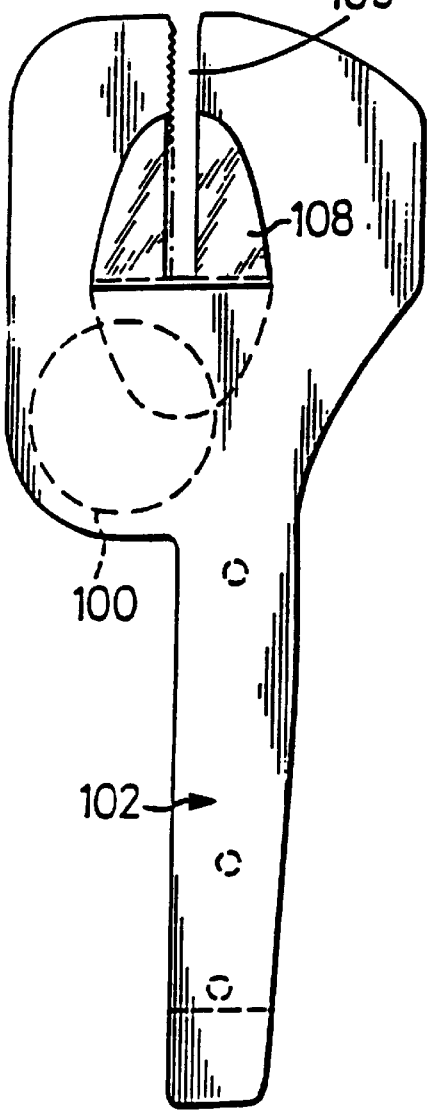

The device is formed as a two part plastics moulding with a thin surgical steel blade secured in an operating handle. FIG. 21 shows an operating handle 97 with a recessed area 98 to receive the thin severing blade (not shown). The end of the handle 97 is provided with a slot for lifting the ridge of flat top cartons. Four pivot pins 99 are moulded into an annular hinge 100 at the boss end of the handle 97. FIGS. 22 and 23 show the two parts 101 and 102 of the housing which are secured together about the handle 97. FIG. 22 shows the upper part 101 of the housing. The part 101 consists of a handle portion 103 and a head portion 104. The head portion 104 is recessed to permit unrestricted passage of the blade across a slot 105. The outer walls of the head portion 104 have ports 106 and 107 to permit the removal of waste material which may become lodged within the recessed portion 104 of the device.

FIG. 23 shows the co-operating part of the two-part housing. The outline shape is substantially identical with the part shown in FIG. 22, so that locating pegs (not shown) on one part cooperate with corresponding blind holes (not shown) in the other part to accurately position the two parts of the housing about the annular hinge 100. A bifurcated tongue 108 projects from the underside of the part of the housing shown in FIG. 23. The slot 105 is aligned with the slot in the tongue so that the carton ridge may be inserted into the slot 105 with the tongue 108 located below the ridge and between the wings of the carton.

Figure 24:
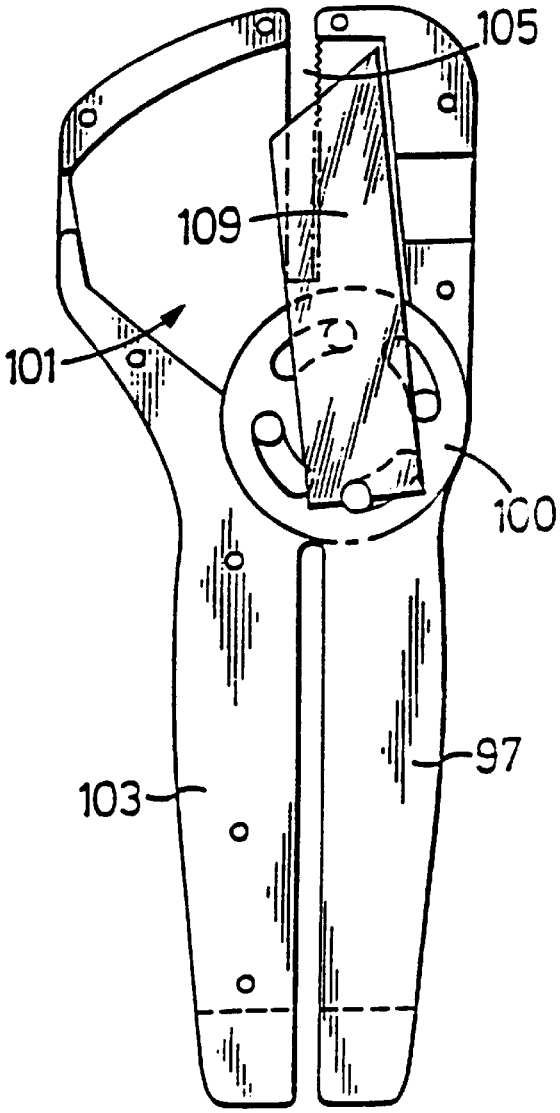

A cross sectional view through an assembled device is shown in FIG. 24. As shown in FIG. 24 a blade 109 secured to the handle 97 moves about the annular hinge 100 within the recessed upper part 101 of the housing.

In use, the tongue 108 is positioned between the wings of a carton and the ridge is pushed fully into the slot 105. The length of the slot 105 ensures that the ridge is severed below the sealed closure for half the width of the ridge. A force is then applied between the handles 97 and 103 so that the blade 109 progressively severs the ridge along the line 10 (shown an FIG. 2). At the end of the cut the device is withdrawn from the carton and the severed portion of the ridge is folded back to free the wings so that the carton may be opened by applying pressure to the wings (as shown in FIG. 4).

Preferably the device is made from a plastics acetal copolymer material available from Hoescht under trade name "HOSTAFORM". Suitable blades are available from Swann Morton Limited of Sheffield. It will be appreciated that if the two part housing is made so that it may be dismantled, the blade may be replaced when worn. As the device provides a single cut action there is no requirement for a return spring, however, a return spring arrangement may be readily incorporated.

Referring to FIGS. 21 to 24 an additional bifurcated tongue may be provided on the upper part 101 of the housing to form a mirror image of the tongue 108 on the lower part 102. As the blade is substantially symmetrically positioned in the housing such a device can be used equally well by left-handed and right-handed people.

What is claimed is:

1. A carton opening device for opening paper cartons having a sealed top with inwardly folded panels which may be folded outwardly after opening to form a pouring spout, comprising:

limiting means; an elongate slot located in a first plane for receiving said folded panels until said panels abut against said limiting means;

severing blade means movable through the slot for severing a portion of said folded panels at one end thereof substantially along said first plane; and guide means of elongate form disposed substantially parallel to and spaced from said first plane and extending in the direction of elongation of said elongate slot for engagement beneath said top to locate the device as severing takes place.

2. A carton opening device according to claim 1, wherein said guide means is a bifurcated tongue that projects from an underside of the device.

3. A device for opening cartons which are formed from paper stock, the sides of which at the top are folded together and sealed as a sealed closure to close the carton and incidentally form inwardly folded panels which, after opening the top, are folded outwardly to form a pouring spout comprising: an elongated guide slot for receiving the sealed closure, a movable bladed severing means hinged with the slot for severing a portion of the sealed closure at a first end thereof along at least a first plane, and limiting means at a closed end of the slot for limiting a length along said first plane of severance of the sealed closure, elongate guide means spaced from and substantially parallel to the plane of the guide slot and from the first plane and extending in a direction of elongation of the guide slot for engaging the carton beneath the sealed closure at the first end and for locating the severing means as the closure is severed.

4. The device of claim 3, wherein the guide means is a bifurcated tongue projecting from an underside of the device.

5. The device of claim 3, wherein the bladed severing means comprises at least one thin movable shear cutting blade.

6. A carton opening device for opening paper cartons, said cartons having a sealed top with inwardly folded panels which may be folded outwardly after opening to form a pouring spout, said device comprising a first handle, a second handle and an annular hinge configured to engage said first handle with said second handle;

said handles defining an elongate slot and limiting means at the end of said slot, wherein said elongate slot is located in a first plane for receiving said folded panels until said panels abut against said limiting means;

severing means secured to said first handle and engageable within said second handle for severing a portion of said folded panels at one end thereof substantially along said first plane; and guide means of elongate form disposed substantially parallel to and spaced apart from said first plane and extending in the direction of said elongate slot, wherein said guide means is configured to engage beneath said top to locate the device while severing takes place.

7. The device of claim 6, wherein said guide means is a bifurcated tongue that projects from an underside of the device.

8. The device of claim 6, wherein said severing means is a shearing apparatus.

9. A method of opening cartons having a sealed top with inwardly folded panels that may be folded outwardly after opening to form a pouring spout, comprising the steps of:

inserting an elongate slot around said inwardly folded panels, wherein said slot is located in a first plane for receiving said folded panels:

locating said slot until further location is prevented by limiting means; and applying manual pressure to severing means, wherein said severing means severs a portion of said folded panels at one end thereof substantially along said first plane, wherein guide means of elongate form disposed substantially parallel to and spaced from said first plane extends in a direction of elongation of said guide slot for engagement beneath said sealed top to locate the device as severing takes place.

* * * * *